US006443522B1

(12) United States Patent
Kain et al.

(10) Patent No.: US 6,443,522 B1
(45) Date of Patent: Sep. 3, 2002

(54) CANOPY ASSEMBLY FOR JUVENILE SEAT

(75) Inventors: James M. Kain, Troy, OH (US); Richard Glover, Greenwood, ID (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/815,699

(22) Filed: Mar. 23, 2001

Related U.S. Application Data

(60) Provisional application No. 60/234,481, filed on Sep. 22, 2000.

(51) Int. Cl.[7] ..... A47D 15/00

(52) U.S. Cl. ..... 297/184.17; 297/183.4

(58) Field of Search ..... 297/183.2, 183.3, 297/183.4, 184.17; 135/96, 133

(56) References Cited

U.S. PATENT DOCUMENTS

| | | | | | |
|---|---|---|---|---|---|
| 4,093,305 | A | * | 6/1978 | Staroste et al. | 297/184.17 |
| 4,978,166 | A | * | 12/1990 | James | 297/184.17 |
| 5,184,865 | A | * | 2/1993 | Mohtasham et al. | 135/133 |
| 5,188,380 | A | * | 2/1993 | Tucek | 297/184.17 |
| 5,551,745 | A | * | 9/1996 | Huang | 297/184.17 |
| 6,027,163 | A | | 2/2000 | Longenecker | |

* cited by examiner

*Primary Examiner*—Peter R. Brown
(74) *Attorney, Agent, or Firm*—Barnes & Thornburg

(57) ABSTRACT

A canopy support is movable relative to a juvenile seat to raise and lower a canopy with respect to the seat. The canopy support includes a hub mount on each side of the seat, an arched canopy frame, and a hub mount ring for connecting each end of the arched canopy frame to one of the hubs. Each hub mount ring is configured to interact with its companion hub to retain the arch canopy frame in a selected position relative to the seat.

22 Claims, 8 Drawing Sheets

CANOPY ASSEMBLY FOR JUVENILE SEAT

This application claims priority under 35 U.S.C. 119(e) to U.S. Provisional Application Serial No. 60/234,481, filed Sept. 22, 2000, which is expressly incorporated by reference herein.

BACKGROUND AND SUMMARY OF THE INVENTION

The present invention relates to a canopy, and particularly, to a canopy used with a juvenile seat. More particularly, the present invention relates to a canopy and canopy frame used with an infant or juvenile seat.

Canopies are used with infant or juvenile seats to protect a child from inclement weather conditions, such as hot sun, wind, rain, and snow. Canopies for juvenile seats frequently are positioned over the juvenile seat to cover at least a child's head and upper torso from such weather conditions. Since weather can change frequently and unexpectedly, it is desirable to have a canopy assembly having some components already coupled to the juvenile seat, the remaining components attaching rapidly to provide a protective cover for the child.

According to the present disclosure, a juvenile seat unit includes a seat and a canopy support movable relative to the seat to raise and lower a canopy with respect to the seat. The canopy support includes a hub coupled to each side of the seat and a hub mount ring anchored to each of the hubs to rotate about a hub axis associated therewith.

An arched canopy frame is included in the juvenile seat unit and is coupled to the hub mount rings to rotate therewith. An interface between at least one of the hubs and its companion hub mount ring provides means for releasably retaining the arched canopy frame in a fixed position relative to the seat selected by the user so that a canopy carried on the canopy support can be retained in a selected position relative to the seat.

Each hub mount ring is formed to include an inner edge defining a circular aperture receiving one of the hubs therein. Each hub mount ring is able to rotate about its companion hub as the arched canopy frame is moved by a user to a selected position.

In preferred embodiments, the interface between each hub and its companion hub mount ring is established by peripherally spaced-apart, radially outwardly extending teeth on the hub and radially inwardly extending teeth on the hub mount ring. The hub mount ring teeth mate with the hub teeth to retain the arched canopy frame in a fixed position relative to the seat at the option of the user.

Each hub mount rim includes first and second C-shaped sections arranged to extend around one of the hubs provided on the side of the seat. The first C-shaped section of each hub mount ring is coupled to the arched canopy frame. Two extensible accordion links are included in each hub mount ring and arranged to interconnect the first and second C-shaped sections so that those sections can move relative to one another.

The canopy support preferably includes two arched canopy frames that cooperate to support the canopy over the seat when the canopy is raised and alongside the seat when the canopy is lowered. Thus, two hub mount rings are anchored to each of the hubs. A first of the arched canopy frames is coupled to a first pair of the hub mount rings and a second of the arched canopy frames is coupled to a second pair of the hub mount rings so that each arched canopy frame can be rotated about an axis extending through the hubs (relative to the seat and to the other arched canopy frame) to raise and lower the canopy.

Features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
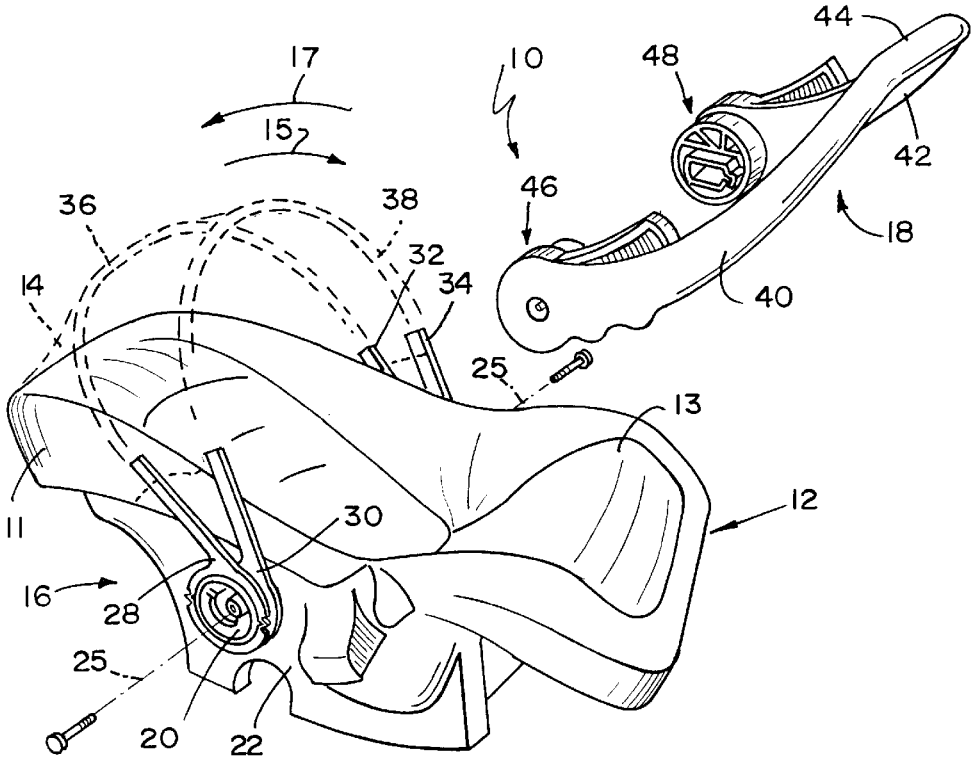
FIG. 1 is a perspective view of a juvenile seat unit including a seat, a canopy made of fabric (shown in phantom), and a canopy support including two arched canopy frames. (shown in phantom) coupled to hub mount rings mounted to rotate on hubs provided on either side of a seat, and showing a carrying handle that can be mounted on the hubs to retain the hub mount rings thereon.
Figure 2:
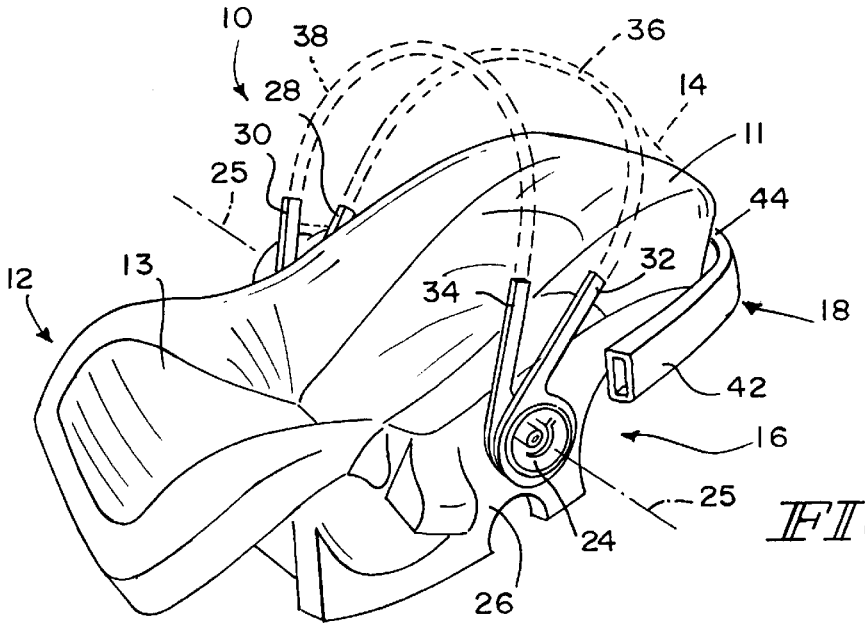
FIG. 2 is a perspective view of the juvenile seat unit of FIG. 1 (taken from another angle) showing the carrying handle in a lowered position alongside the rear of the seat.

A juvenile seat unit 10 includes a seat 12 having a seat back 11 and seat bottom 13, a canopy 14, a canopy support 16, and a carrying handle 18 as shown, for example, in FIGS. 1 and 2. Canopy support 16 is adapted to carry canopy 14 and is coupled to seat 12 to raise and lower canopy 14 with respect to seat 12. Canopy 14 is raised by moving canopy 14 away from seat back 11 in direction 15 and lowered by moving canopy 14 toward seat back 11 in direction 17.

The canopy support 16 includes a left hub 20 coupled to a left side 22 of seat 12 as shown in FIG. 1 and a right hub 24 coupled to a right side 26 of seat 12 as shown in FIG. 2. Canopy support 16 further includes two hub mount rings 28, 30 mounted for rotation on left hub 20 about hub axis 25, and two hub mount rings 32, 34 mounted for rotation on right hub 24 about hub axis 25. Canopy support 16 also includes a first arched canopy frame 36 coupled to hub mount rings 28, 32 to rotate therewith and a second arched canopy frame 38 coupled to hub mount rings 30, 34 to rotate therewith about hub axis 25.

Figure 7:
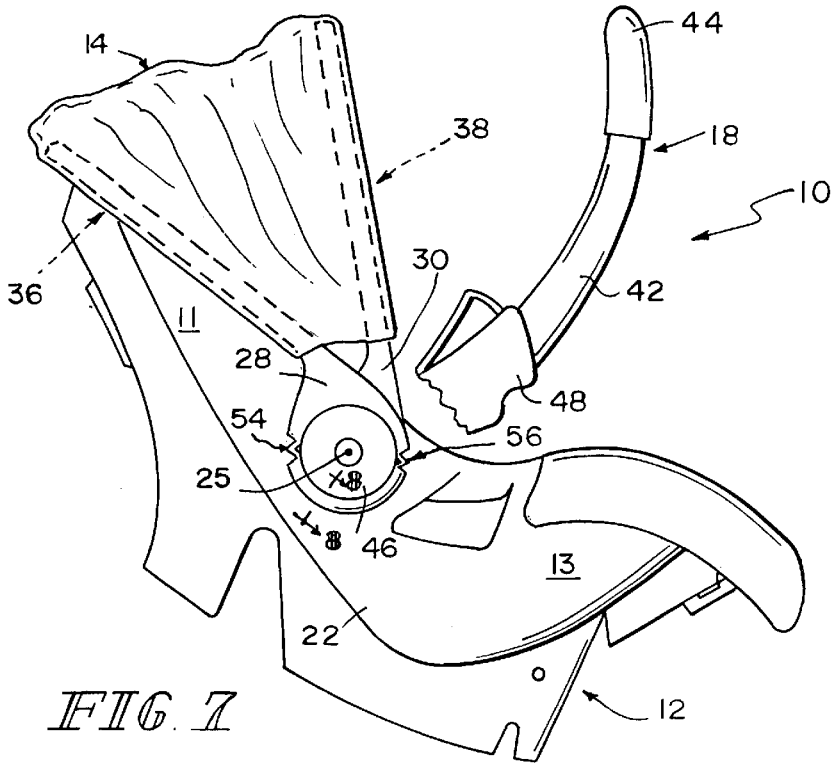
FIG. 7 is a side elevation of the juvenile seat unit of FIGS. 1 and 2 showing the canopy in a partly raised position and showing that portions of the hub mount rings are trapped between a first side of the seat and a distal end of the carrying handle coupled to the hub provided on the first side of the seat.

Carrying handle 18 includes a left arm 40, a right arm 42, and a grip handle 44 interconnecting the left and right arms 40, 42 as shown, for example, in FIGS. 1, 2, 4, and 8. A first handle support 46 is provided on a distal end of left arm 40 adapted to be mounted for rotation on left hub 20. Likewise, a second handle support 48 is provided on a distal end of right arm 42 and adapted to be mounted for rotation on right hub 24. Handle supports 46, 48 function to support carrying handle 18 for rotation about hub axis 25 from a storage position alongside seat aback 11 as shown in FIG. 2 to a use position above seat 12 as shown in FIG. 7. Handle supports 46, 48 also cooperate to provide means for blocking removal of hub mount rings 28, 30, 32, 34 from hubs 20, 24 in the manner shown, for example, in FIGS. 7 and 8.

Figure 3:
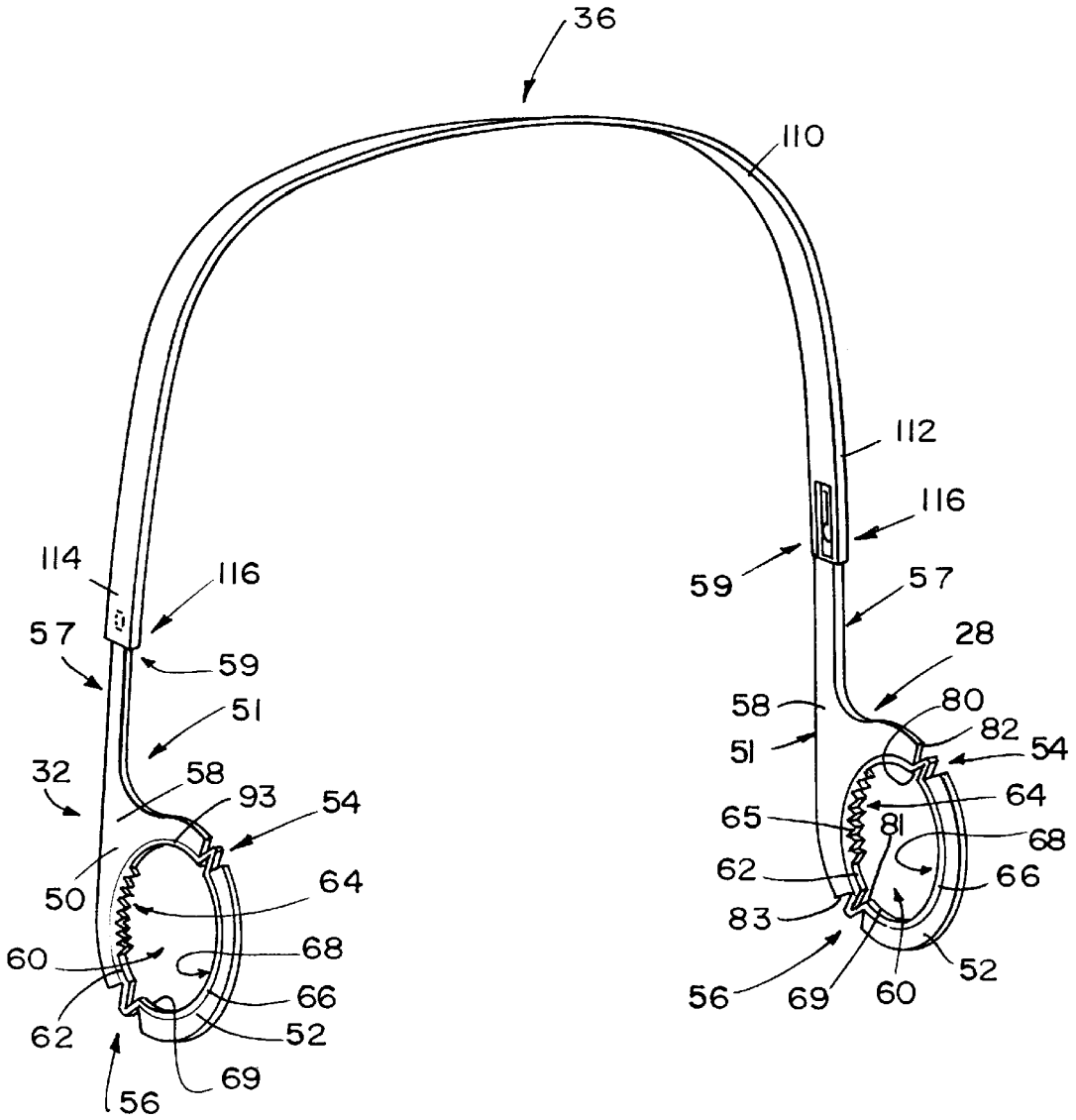
FIG. 3 is an enlarged perspective view of a portion of the canopy support of FIGS. 1 and 2 showing an arched canopy frame and a hub mount ring coupled to each end of the arched canopy frame and showing that each hub mount ring includes a first C-shaped section carrying a frame support (or neck) coupled to one end of the arched canopy frame, a second C-shaped section, and a pair of extensible accordion links arranged to interconnect the two C-shaped sections to form an aperture sized to receive one of the hubs provided on the side of the seat therein.

Referring now to FIG. 3, each of hub mount rings 28, 32 includes first and second C-shaped sections 50, 52 and first and second extensible accordion links 54, 56. A frame support or neck 57 included in arched canopy frame 56 has an inner end 58 coupled to first C-shaped section 50 and an outer end 59 adapted to be coupled to a central frame member 110 also included in arched canopy frame 36. (Neck 57 and central frame member 110 are described in more detail below.) In the illustrated embodiment, neck 57 and first C-shaped section 50 cooperate to define an "inverted" Y-shaped member 51. C-shaped sections 50, 52 extensible accordion links 54, 56, and neck 57 are also included in hub mount rings 30, 34 as shown, for example, in FIG. 4.

Extensible accordion links 54, 56 cooperate to allow movement of each first C-shaped section 50 relative to its companion second C-shaped section 52. As shown, for example, in FIGS. 3 and 4, one end of each first C-shaped section 50 is coupled to one end of a companion second C-shaped section 52 by a first extensible link 54, and another end of each first C-shaped section 50 is coupled to another end of a companion second C-shaped section 52 by a second extensible link 56. Each of links 54, 56 is made of an elastic material and is thus able to stretch and contract along its length so that companion C-shaped sections 50, 52 included in each of hub mount rings 28, 30, 32, 34 can move toward and away from one another.

Figure 4:
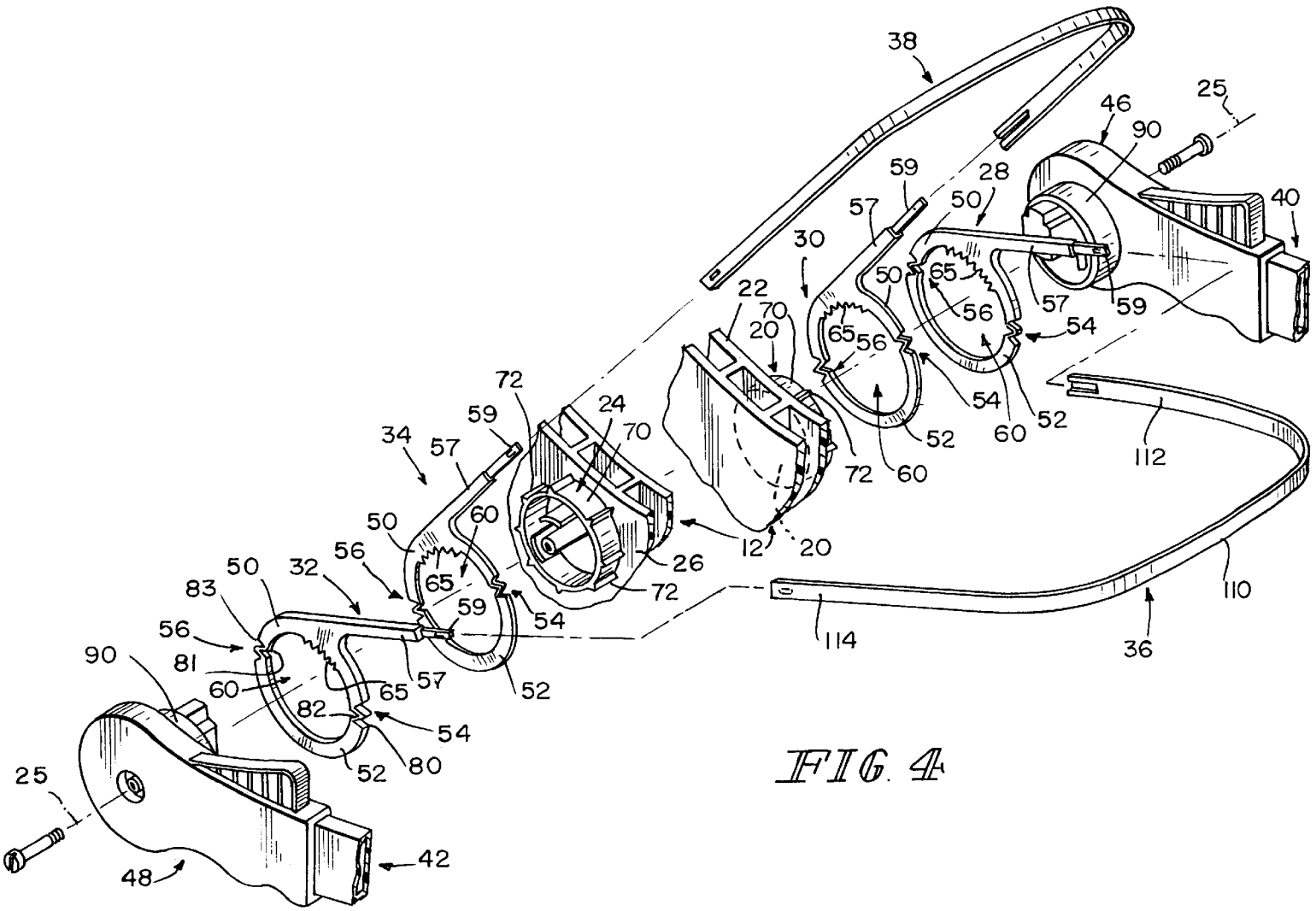
FIG. 4 is a perspective view similar to FIG. 3 showing one of the hubs provided on the side of the seat, four hub mounting rings, two arched canopy frames for supporting a fabric canopy over the seat, and spaced-apart distal ends of the carrying handle, and showing eight radially outwardly extending teeth on the hub and a toothed section including a plurality of radially inwardly extending teeth on an inner edge of each first C-shaped section of the four illustrated hub mounting rings.

Each of hub mount rings 28, 30, 32, 34 includes an inner edge defining a circular aperture 60 sized to received one of the canopy support hubs 20, 24 therein as suggested, for example, in FIG. 4 and also in FIGS. 1 and 2. The inner edge of each hub mount ring 28, 30, 32, 34 includes edge 62 on first C-shaped section 50 and edge 66 on the companion second C-shaped section 52.

Figure 5:
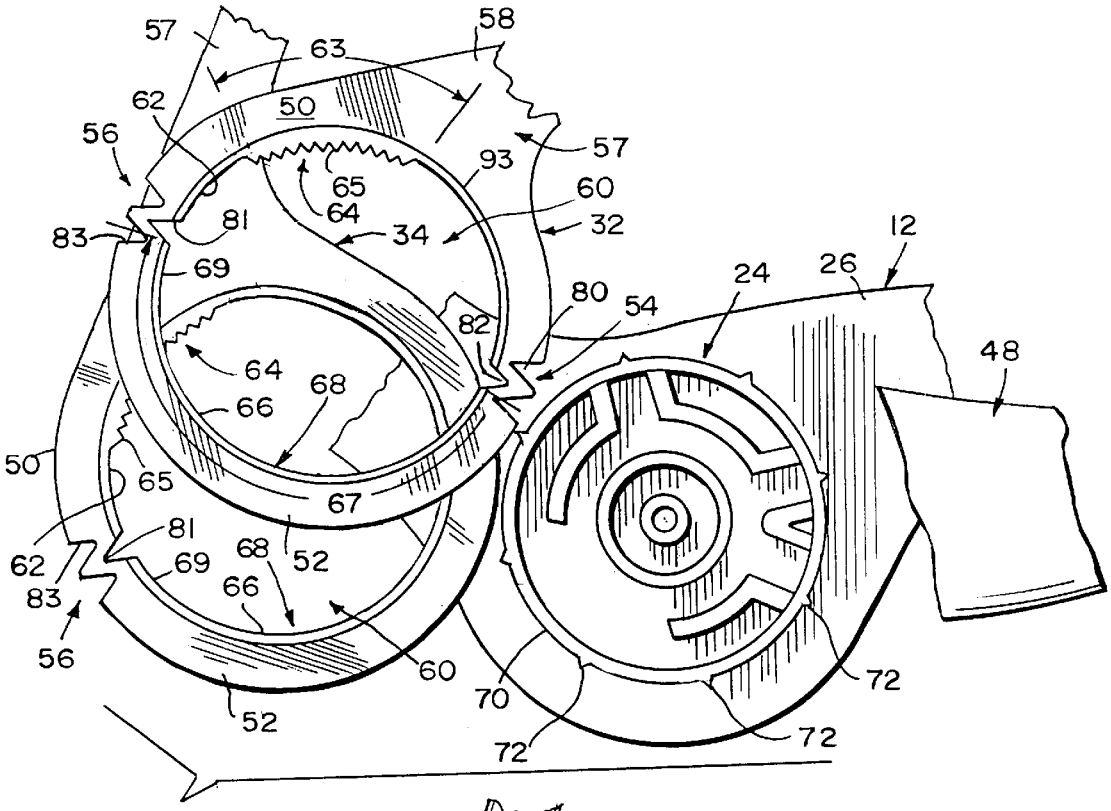
FIG. 5 is an enlarged side elevation view of the hub and two of the hub mounting rings shown in FIG. 4 showing that each hub mounting ring includes an inner edge sized to define a hub-receiving aperture and showing that the inner edge on the second C-shaped section is provided with a smooth peripheral segment of smooth surface for movement over the hub teeth (during rotation of the hub mounting ring about the hub axis) and that the inner edge on the first C-shaped section is provided with a toothed peripheral segment including the radially inwardly extending teeth.

A toothed peripheral segment 64 including a plurality of radially inwardly extending teeth 65 is provided on the inner edge 62 of first C-shaped section 50 as shown, for example, in FIGS. 3 and 4. The toothed peripheral segment 64 is arcuate and subtends an angle 63 of about 115 degrees as shown in FIG. 5.

A smooth peripheral segment 68 including a smooth surface 69 is provided on the inner edge 66 of second C-shaped section 52. The smooth peripheral segment 68 is arcuate and subtends an angle 67 of about 180 degrees as shown in FIG. 5.

Each canopy support hub 20, 24 includes a cylindrical wall 70 having a diameter sized to fit into aperture 60 formed in each hub mount ring 28, 30, 32, 34 so that each of rings 28, 30, 32, 34 can be mounted on one of canopy support hubs 20, 24 to rotate about the hub axis 25. Each hub 20, 24 further includes a plurality of peripherally spaced-apart, radially outwardly extending hub teeth 72 on cylindrical wall 70 as shown, for example, in FIGS. 4–6.

Figure 6:
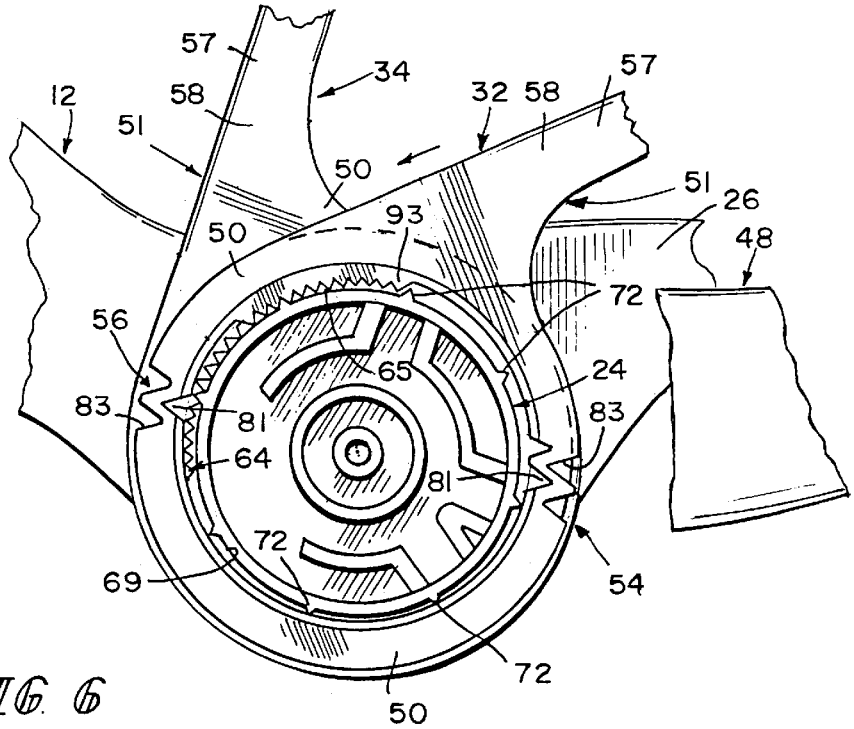
FIG. 6 is an elevation view similar to FIG. 5 showing that the radially inwardly extending teeth on the hub mount rings mate with the radially outwardly extending teeth on the hub to retain each hub mount ring and arched canopy frame in a fixed position relative to the seat selected by a user so that a canopy carried on the canopy support can be retained in a selected position relative to the seat.

As suggested, for example, in FIG. 6, the radially inwardly extending teeth 65 in the toothed peripheral segment 64 of each hub mount ring 28, 30, 32, 34 engage the hub teeth 72 on one of hubs 20, 24 to retain the hub mount rings 28, 30, 32, 34 in selected fixed positions relative to hubs 20, 24. This causes the arched canopy frames 36, 38, which frames 36, 38 are coupled to the hub mount rings 28, 30, 32, 34, to be retained in selected fixed positions relative to seat 12 so as to establish a position of the canopy 14 carried on the arched canopy frames 36, 38 relative to the seat.

By rotating the hub mount rings 28, 30, 32, 34 about the hub axis 25 relative to the hubs 20, 24, the radially inwardly extending teeth 65 in the toothed peripheral segment 64 of each hub mount ring 28, 30, 32, 34 ratchet or otherwise move relative to hub teeth 72 on hubs 20, 24 to enable a user to move the arched canopy frames 36, 38 about hub axis 25 and thereby raise and lower canopy 14 with respect to seat 12. Such ratcheting movement is facilitated by extension and contraction of the extensible accordion links 54, 56 provided to couple the C-shaped sections 50, 52 for relative movement to one another in each hub mount ring 28, 30, 32, 34.

First extensible link 54 is defined by a first V-shaped slot 80 positioned to interrupt smooth surfaces on edges 62, 66 of C-shaped sections 50, 52 and a first W-shaped slot 82 positioned to interrupt an outer peripheral edge 84 of C-shaped sections 50, 52. Second extensible link 56 is defined by a second V-shaped slot 81 positioned to interrupt smooth surfaces on edges 62, 66 of C-shaped sections and a second W-shaped slot 83 positioned to interrupt outer peripheral edge 84. The pair of extensible accordion links 54, 56 in each hub mount ring 28, 30, 32, 34 are arranged to lie in spaced-apart relation to one another to interrupt the inner edge in two spaced-apart places associated with the location of the extensible accordion links 54, 56 as shown, for example, in FIGS. 3–5.

Figure 8:
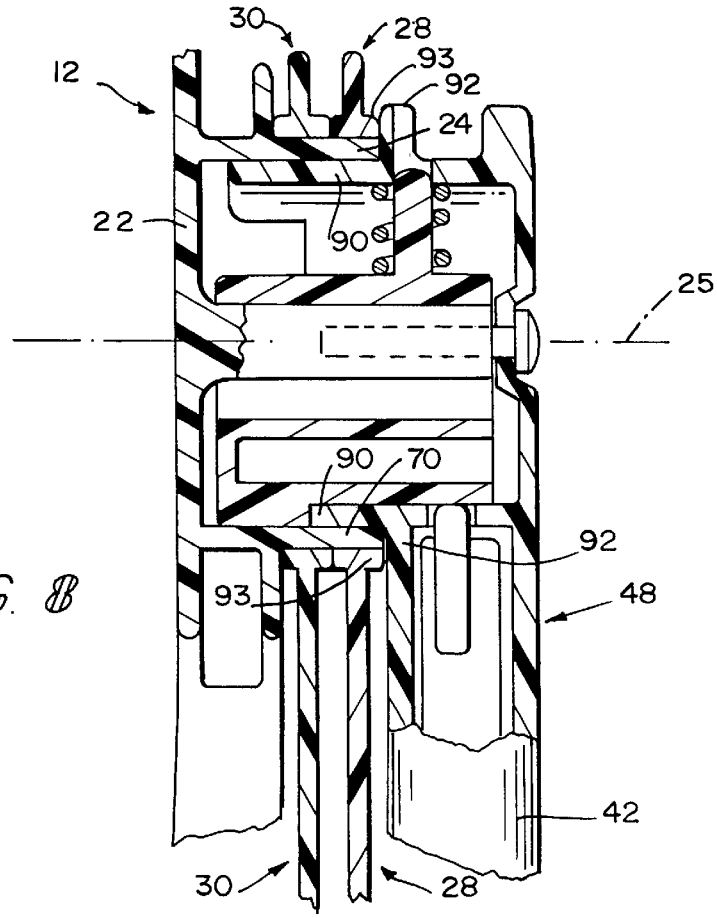
FIG. 8 is a sectional view taken along line 8—8 of FIG. 7.
Figure 9:
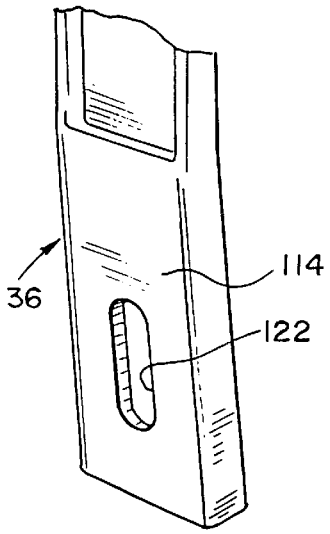
FIGS. 9 and 10 are enlarged perspective views of one distal end of the arched canopy frames shown in FIG. 3.
Figure 10:
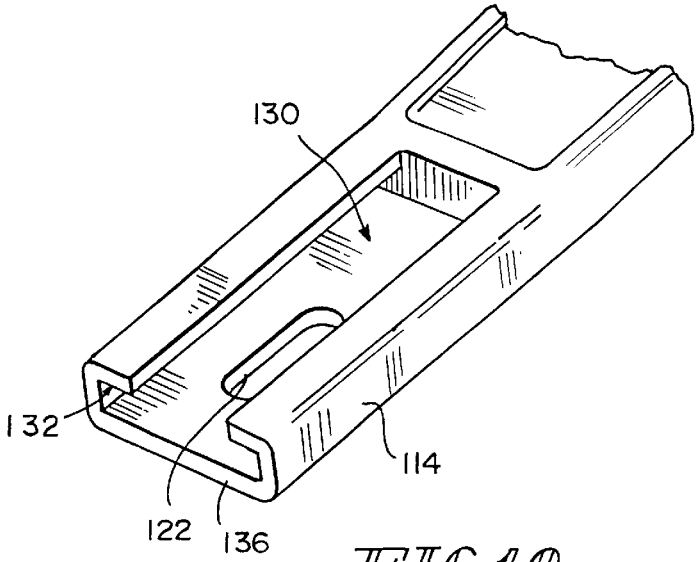
Figure 11:
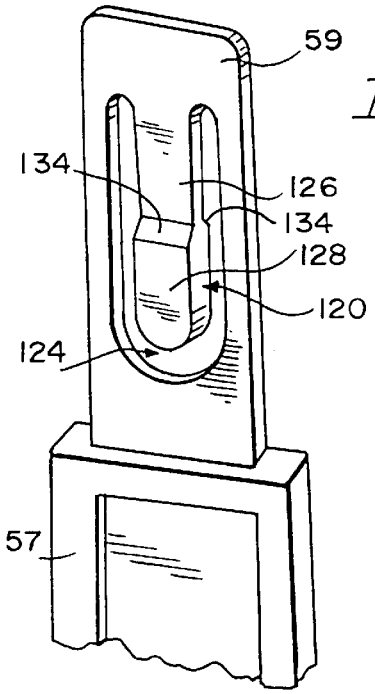
FIGS. 11 and 12 are enlarged perspective views of the distal end of the frame supports included in the hub mounting rings shown in FIG. 3.
Figure 12:
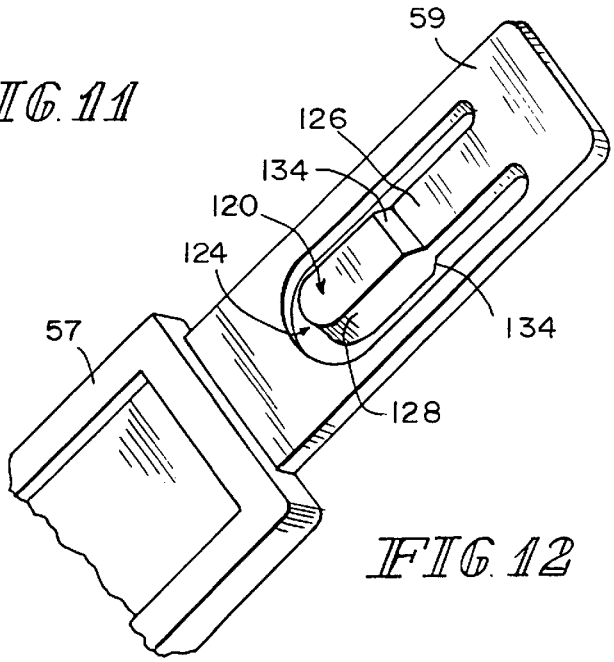
Figure 13:
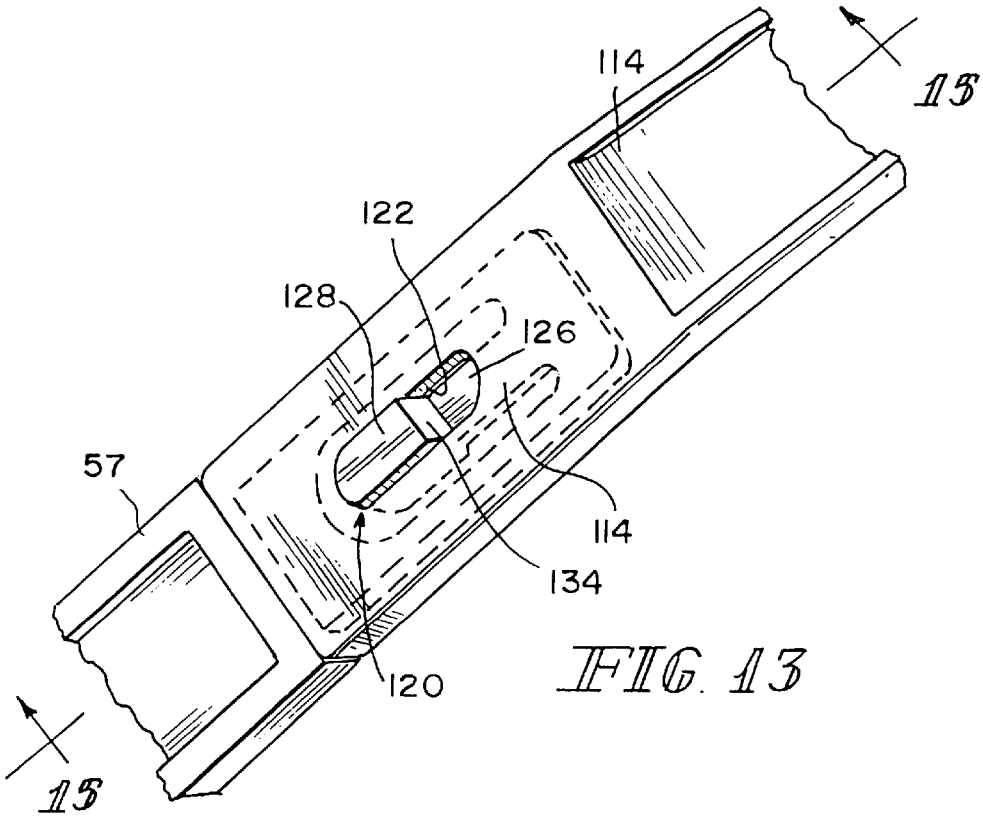
FIG. 13 is a perspective view showing a distal end of a canopy support frame coupled to a distal end of a frame support included in a hub mounting ring.
Figure 14:
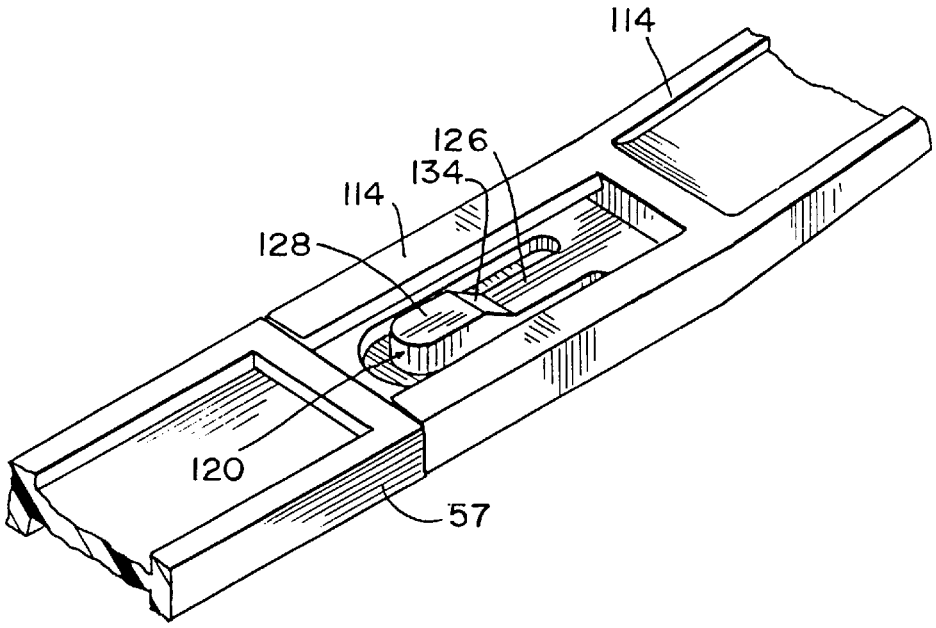
FIG. 14 is a view similar to FIG. 13 showing a reverse side of the coupled distal ends.
Figure 15:
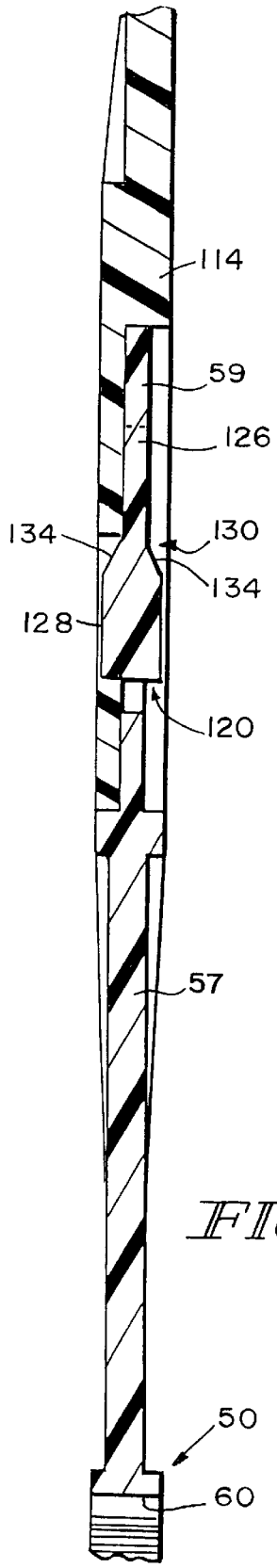
FIG. 15 is a sectional view taken along line 15—15 of FIG. 13.

As shown best in FIGS. 7 and 8, second handle support 48 of carrying handle 18 is coupled to hub 24 and arranged to provide means for blocking removal of hub mount rings 28, 30 from hub 24. In the illustrated embodiment, handle support 48 includes a sleeve 90 that extends into an opening bounded by cylindrical wall 70 and an annular flange 92 extending radially outwardly from sleeve 90 to engage a rim 93 provided on hub mount ring 28 so that hub mount rings 28, 30 are trapped (yet rotatable about hub axis 25) between left side 22 of seat 12 and annular flange 92. A similar arrangement is provided on handle support 46 to retain hub mount rings 32, 34 on hub 20.

Referring now to FIGS. 3 and 4, each arched canopy frame 36, 38 includes a central frame member 110 having opposite distal ends 112, 114 and a neck 57 coupled to a companion hub mount ring 28, 30, 32, or 34 to rotate therewith about hub axis 25. One connector 116 is provided to connect distal end 112 of central frame member 110 to the neck 57 coupled to hub mount ring 28 and another connector 116 is provided to connect distal end 114 of central frame member 110 to the neck 57 coupled to hub mount ring 30 as shown in FIG. 3.

Each connector 116 includes a locking tab 120 provided on neck 57 and a tab-receiving aperture 122 provided in one of distal ends 112, 114 and sized to receive a locking tab 120 therein as shown, for example, in FIGS. 9–16. The outer end 59 of each neck 57 is formed to include an opening 124 and the locking tab 120 is cantilevered to outer end 59 to lie in opening 124 and move relative to outer end 59 to engage and disengage tab-receiving aperture 122 as shown, for example, in FIGS. 15 and 16. Locking tab 120 includes a cantilevered body 126 coupled to outer end 59 and a head 128 appended to cantilevered body 126 and sized to fit into tab-receiving aperture 122.

Figure 16:
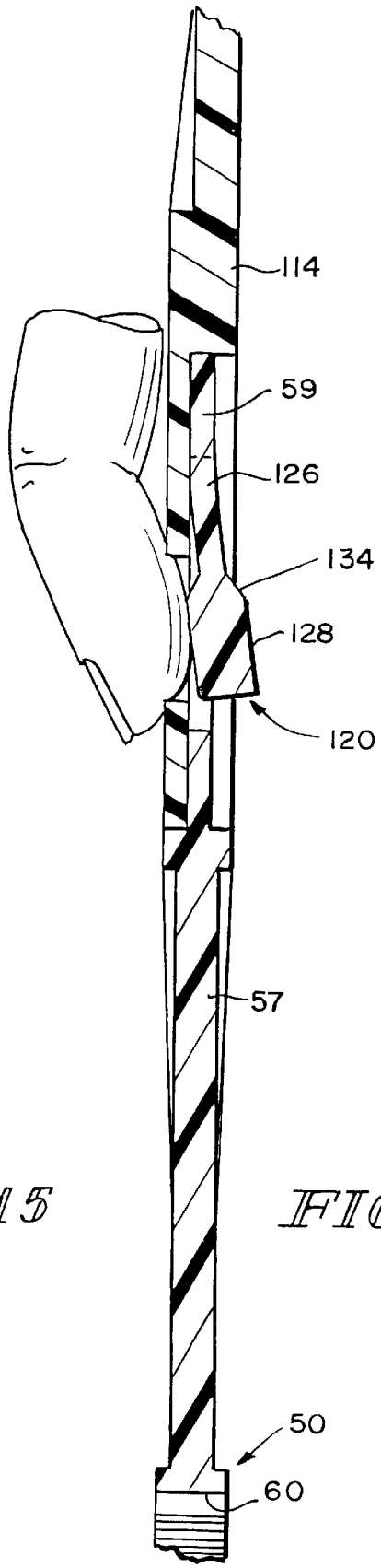
FIG. 16 is a view similar to FIG. 15 showing movement of a locking tab to release a locked connection between the distal end of the arched canopy frame in a canopy support and the distal end of the support frame in a hub mount ring.

Each distal end 112, 114 of central frame member 110 also includes a chamber 130 having an opening 132 and being sized to receive outer end 59 of a companion neck 57 therein as shown, for example, in FIGS. 9–16. Once inserted into chamber 130, locking tab 120 will move automatically to cause head 128 of tab 120 to fit into tab-receiving aperture 122. Ramp 134 on head 128 will cam an edge 136 on distal end 114 to deflect head 128 until it moves relative to distal end 114 to a position where it will snap into tab-receiving aperture 122 to establish a releasable connection between neck 57 and distal end 114 during movement of outer end 59 into chamber 130. Manual movement of head 128 to "break" that releasable connection between neck 57 and distal end 114 of central frame member 110 is shown in FIG. 16.

Although the invention has been described in detail with reference to certain preferred embodiments, variations and modifications exist within the scope and spirit of the invention as described and defined in the following claims.

What is claimed is:

1. A juvenile seat unit comprising a seat adapted to receive a juvenile therein and a canopy support adapted to carry a canopy and coupled to the seat for movement relative to the seat to raise and lower a canopy with respect to the seat, the canopy support including a pair of hubs coupled to the seat, a first pair of hub mount rings, each hub mount ring anchored to one of the hubs for rotation about a hub axis, an arched canopy frame coupled to the pair of hub mount rings to rotate therewith, each hub mount ring being formed to include an inner edge defining a circular aperture receiving said one of the hubs therein to permit rotation of the hub mount rings relative to the hubs about the hub axes as the arched canopy frame is moved by a user to a selected position, and means for releasably retaining the arched canopy frame in a fixed position relative to the seat selected by a user so that a canopy carried on the canopy support can be retained in a selected position relative to the seat.

2. The unit of claim 1, further comprising means for blocking removal of the hub mount rings from the hubs.

3. The unit of claim 2, further comprising a carrying handle coupled to the hubs for rotation about the hub axes and formed to include the blocking means.

4. The unit of claim 2, further comprising a second pair of hub mount rings, each hub mount ring in the second pair being anchored to one of the hubs for rotation about a hub axis and relative to an adjacent one of the hub mount rings in the first pair, and wherein the blocking means is coupled to the hubs to block removal of every hub mount ring from the hubs.

5. The unit of claim 2, wherein the arched canopy frame includes a central frame member, a neck permanently appended to each hub mount ring to rotate therewith, and a connector configured to connect each neck to the central frame member to support the central frame member for rotation about the hub axis relative to the seat and to release the central frame member for separation from the neck.

6. The unit of claim 5, wherein the central frame member includes opposite distal ends, each distal end is formed to include a tab-receiving aperture, each connector includes a locking tab provided on the neck for movement relative to the link to extend into the tab-receiving aperture formed in the central frame member.

7. The unit of claim 1, wherein the retaining means includes peripherally spaced-apart, radially outwardly extending hub teeth on at least one of the hubs and the inner edge of a hub mount ring associated with the at least one of the hubs is provided with a smooth peripheral segment of smooth surface for movement over the hub teeth.

8. The unit of claim 7, wherein the retaining means further includes a toothed peripheral segment of radially inwardly extending teeth on the inner edge of the hub mount ring associated with the at least one of the hubs for releasably engaging the hub teeth to retain the arched canopy frame in a fixed position relative to the seat.

9. The unit of claim 8, wherein the toothed peripheral segment is arcuate to subtend an angle of about 115 degrees and the smooth peripheral segment is arcuate to subtend an angle of about 180 degrees.

10. The unit of claim 8, wherein the hub mount ring associated with the at least one of the hubs further includes a pair of extensible accordion links arranged to lie in spaced-apart relation to one another to bifurcate the inner edge of said hub mount ring into a first section containing the toothed peripheral segment and a first portion of the smooth peripheral segment and a second section containing a second portion of the smooth peripheral segment.

11. The unit of claim 7, wherein the hub mount ring associated with the at least one of the hubs is formed to include an outer peripheral edge, a first V-shaped slot positioned to interrupt the smooth surface, and a first W-shaped slot positioned to interrupt the outer peripheral edge and to lie opposite to the first V-shaped slot to define a first extensible accordion link therebetween.

12. The unit of claim 11, wherein the hub mount associated with the at least one of the hubs is formed to include a second V-shaped slot positioned to interrupt the smooth surface and a second W-shaped slot positioned to interrupt the outer peripheral edge and to lie opposite to the second V-shaped slot to define a second extensible accordion link therebetween and in spaced-apart relation to the first extensible accordion link.

13. The unit of claim 1, wherein each hub mount ring includes a pair of extensible accordion links arranged to lie in spaced-apart relation to one another and to interrupt the inner edge in two spaced-apart places associated with the location of the extensible accordion links.

14. The unit of claim 13, wherein each hub mount ring includes a first C-shaped section providing a first portion of the inner edge and a second C-shaped section providing a second portion of the inner edge, each end of the second C-shaped section is coupled to one of the ends of the first C-shaped section by one of the first and second extensible accordion links to permit movement of the second C-shaped section relative to the first C-shaped section.

15. The unit of claim 14, wherein the retaining means includes peripherally spaced-apart radially outwardly extending hub teeth on each hub and a toothed peripheral segment of radially inwardly extending teeth on the inner edge located on the first C-shaped section to releasably engage hub teeth to retain the arched canopy frame in a fixed position relative to the seat.

16. The unit of claim 15, wherein the inner edge located on each second C-shaped section is provided with a smooth surface for movement over the hub teeth.

17. A juvenile seat unit comprising a seat bottom, a seat back, and sides adapted for receiving a child therein, and a canopy assembly adapted to cover at least a portion of a child in the juvenile seat, the canopy assembly including a mount for holding at least a portion of the canopy assembly, the mount including, at each side of the seat, a hub providing a transverse axis about which at least a portion of the canopy assembly moves, at least one hub having peripherally spaced-apart, radially outwardly extending hub teeth, an arched frame having a pair of opposing distal ends, one distal end positioned at each side, the arched frame being adapted to support a portion of a canopy cover, and a base for attaching each distal end of the arched frame to its associated hub for movement about the hub, each base providing an inner edge defining an aperture for receiving the associated hub, the inner edge of at least one base being provided with a peripheral segment of radially inwardly extending teeth for releasably engaging the hub teeth to establish a position of the arched frame relative to the seat and a peripheral segment of smooth surface for movement over the hub teeth.

18. The unit of claim 17, wherein the at least one base includes an outer peripheral edge, a V-shaped slot positioned to interrupt the smooth surface, and a W-shaped slot positioned to interrupt the outer peripheral edge and to lie opposite to the V-shaped slot.

19. The unit of claim 17, wherein each distal end includes side walls and flanges which cooperate to form a locking chamber configured to receive a locking tab of the base.

20. A juvenile seat unit comprising a seat bottom, a seat back and sides, and hubs positioned at each side, each hub providing a pivot axis and having hub teeth peripherally spaced apart about the hub, and a canopy assembly including a base provided one each side and permanently coupled to the hub for movement about one of the pivot axes, the base being formed to include a locking tab, at least one base including a toothed peripheral segment of teeth positioned to engage the hub teeth and a smooth peripheral segment of smooth surface for movement over the hub teeth, and a canopy frame positioned over the juvenile seat and having a pair of distal ends, one distal end disposed on each side and releasably coupled to the locking tab of each base, the canopy frame being adapted to support at least a portion of a canopy cover.

21. The unit of claim 20, wherein each base includes an outer peripheral edge, a V-shaped slot positioned to interrupt the smooth surface, and a W-shaped slot positioned to interrupt the outer peripheral edge and to lie opposite to the V-shaped slot.

22. The unit of claim 20, wherein each distal end includes side walls and flanges which cooperate to form a locking chamber configured to receive a locking tab of base.

* * * * *